US009929498B2

(12) United States Patent
Thakare et al.

(10) Patent No.: US 9,929,498 B2
(45) Date of Patent: Mar. 27, 2018

(54) CONNECTOR ASSEMBLY WITH TORQUE SLEEVE

(71) Applicant: Amphenol Corporation, Wallingford, CT (US)

(72) Inventors: Rakesh Thakare, Danville, VA (US); Caichun Song, Changzhou (CN); Michael Holland, Santa Barbara, CA (US)

(73) Assignee: TIMES FIBER COMMUNICATIONS, INC., Wallingford, CT (US)

( * ) Notice: Subject to any disclaimer, the term of this patent is extended or adjusted under 35 U.S.C. 154(b) by 0 days.

(21) Appl. No.: 15/254,360

(22) Filed: Sep. 1, 2016

(65) Prior Publication Data

US 2018/0062307 A1 Mar. 1, 2018

(51) Int. Cl.
*H01R 13/622* (2006.01)

(52) U.S. Cl.
CPC ..... *H01R 13/622* (2013.01)

(58) Field of Classification Search
CPC ..... H01R 13/622
See application file for complete search history.

(56) References Cited

U.S. PATENT DOCUMENTS 3,323,098 A 5/1967 O'Keefe et al.
4,116,521 A 9/1978 Herrmann, Jr.
4,408,821 A 10/1983 Forney, Jr.
4,441,775 A 4/1984 Walters
4,452,503 A 6/1984 Forney, Jr.
4,660,921 A 4/1987 Hauver
4,690,481 A 9/1987 Randolph
4,854,893 A 8/1989 Morris
5,002,503 A 3/1991 Campbell et al.
5,007,861 A 4/1991 Stirling
5,067,750 A 11/1991 Minneman
5,073,129 A 12/1991 Szegda
5,141,451 A 8/1992 Down
5,192,219 A * 3/1993 Fowler ..... H01R 13/622 285/92
5,217,393 A 6/1993 Del Negro et al.
5,295,864 A 3/1994 Birch et al.
(Continued)

*Primary Examiner* — Briggitte R Hammond
(74) *Attorney, Agent, or Firm* — Blank Rome LLP; Charles R. Wolfe, Jr.; Tara L. Marcus

(57) ABSTRACT

A connector assembly that has a connector including a coupling member rotatably coupled to a body, and the coupling member has an interface end configured to engage a mating connector. A gripping sleeve receives at least a portion of the body and at least a portion of the coupling member. A torque limiting feature includes a slip element located at or near the front end of the gripping sleeve and an engaging element located on the coupling member. The slip element and the engaging element engage one another such that rotation of the gripping sleeve applies torque to and rotates the coupling member in a tightening direction until a predetermined torque limit is reached when the slip element disengages from the engaging element allowing the gripping sleeve to rotate with respect to the coupling member such that torque is no longer applied to the coupling member by the gripping sleeve.

39 Claims, 6 Drawing Sheets

(56) References Cited

U.S. PATENT DOCUMENTS 5,297,458 A * 3/1994 Smith ..... B25B 13/06 81/124.2
5,316,348 A * 5/1994 Franklin ..... F16L 35/00 138/110
5,352,134 A 10/1994 Jacobsen et al.
5,435,745 A 7/1995 Booth
5,456,614 A 10/1995 Szegda
5,466,173 A 11/1995 Down
5,474,470 A 12/1995 Hammond, Jr.
5,499,934 A 3/1996 Jacobsen et al.
5,548,088 A 8/1996 Gray et al.
5,598,132 A 1/1997 Stabile
5,651,699 A 7/1997 Holliday
5,653,605 A * 8/1997 Woehl ..... H01R 13/622 439/321
5,660,565 A 8/1997 Williams
6,027,373 A 2/2000 Gray et al.
6,034,325 A 3/2000 Nattel et al.
6,331,123 B1 12/2001 Rodrigues
D462,327 S 9/2002 Montena
6,454,462 B2 9/2002 Nguyen et al.
6,767,247 B2 7/2004 Rodrigues et al.
6,808,415 B1 10/2004 Montena
6,817,272 B2 11/2004 Holland
6,884,115 B2 4/2005 Malloy
6,887,102 B1 5/2005 Burris et al.
6,971,912 B2 12/2005 Montena et al.
7,014,501 B2 3/2006 Montena
7,029,304 B2 4/2006 Montena
7,059,900 B2 6/2006 Holliday
7,097,500 B2 8/2006 Montena
7,128,603 B2 10/2006 Burris et al.
7,147,509 B1 * 12/2006 Burris ..... H01R 9/0521 439/578
7,163,420 B2 1/2007 Montena
7,181,999 B1 2/2007 Skeels et al.
7,226,300 B2 6/2007 Khemakhem
7,311,555 B1 12/2007 Burris et al.
7,329,149 B2 2/2008 Montena
7,341,129 B2 3/2008 Hsieh
7,347,129 B1 * 3/2008 Youtsey ..... B25B 13/06 81/124.2
7,364,462 B2 4/2008 Holland
7,544,094 B1 6/2009 Paglia et al.
7,618,276 B2 11/2009 Paglia et al.
7,727,011 B2 6/2010 Montena et al.
7,780,386 B2 * 8/2010 Lau ..... H01R 13/622 411/7
7,798,849 B2 9/2010 Montena
7,837,501 B2 11/2010 Youtsey
7,874,871 B2 1/2011 Montena
7,892,005 B2 2/2011 Haube
7,946,199 B2 5/2011 Bradley
7,997,930 B2 8/2011 Ehret et al.
8,016,605 B2 9/2011 Montena et al.
8,016,612 B2 9/2011 Burris et al.
8,065,940 B2 11/2011 Wilson et al.
8,287,310 B2 * 10/2012 Burris ..... H01R 24/40 439/578
8,342,879 B2 1/2013 Amidon et al.
8,444,445 B2 5/2013 Amidon et al.
8,465,322 B2 6/2013 Purdy
8,490,525 B2 7/2013 Wilson et al.
8,568,164 B2 10/2013 Ehret et al.
8,568,167 B2 10/2013 Montena
8,882,520 B2 11/2014 Youtsey
8,944,837 B2 2/2015 Huang
9,028,276 B2 5/2015 Wilson et al.
9,048,599 B2 6/2015 Burris
9,124,046 B2 9/2015 Ehret et al.
9,153,917 B2 10/2015 Purdy
9,172,181 B2 10/2015 Huang
D743,891 S 11/2015 Shaw et al.
9,240,636 B2 1/2016 Youtsey
2002/0013088 A1 1/2002 Rodrigues et al.
2004/0194585 A1 10/2004 Clark
2004/0231126 A1 11/2004 Louwagie et al.
2005/0020129 A1 * 1/2005 Dykstra ..... H01R 9/0521 439/578
2006/0213059 A1 9/2006 Eggert
2010/0199813 A1 8/2010 Phillips et al.
2015/0295368 A1 10/2015 Wilson et al.
2015/0325932 A1 11/2015 Ehret et al.
2016/0181742 A1 6/2016 Wilson et al.
2017/0365949 A1 12/2017 Montena et al.

* cited by examiner

CONNECTOR ASSEMBLY WITH TORQUE SLEEVE

FIELD OF THE INVENTION

The present invention relates to a connector assembly with a torque sleeve that facilitates attachment of the connector assembly to a mating connector, port or equipment while also preventing the potential damaging impact of overtightening the connector assembly, mating connector, port, or equipment.

BACKGROUND OF THE INVENTION

Coaxial cable connectors are typically used to connect a coaxial cable with a mating connector, port or terminal of another device, such as equipment, appliances, and the like. Proper tightening of the connector is required to maintain an electrical connection and maximize electrical performance. Overtightening of the connector, however, may result in damage to the connector and/or its mating connector or port and not providing optimum electrical performance.

Therefore, a need exists for connector assembly that facilitates proper tightening of the connector while also preventing potentially damaging overtightening of the connector.

SUMMARY OF THE INVENTION

Accordingly, the present invention may provide a connector assembly comprising a connector that includes a coupling member rotatably coupled to a body, and the coupling member has an interface end configured to engage a mating connector, port, or equipment. A gripping sleeve receives at least a portion of the body in a rear end thereof and at least a portion of the coupling member in a front end thereof. A torque limiting feature includes a slip element that is located at or near the front end of the gripping sleeve and an engaging element that is located on the coupling member. The slip element and the engaging element engage one another such that rotation of the gripping sleeve applies torque to and rotates the coupling member in a tightening direction until a predetermined torque limit is reached when the slip element disengages from the engaging element allowing the gripping sleeve to rotate with respect to the coupling member such that no additional torque is applied to the coupling member by the gripping sleeve beyond the predetermined torque limit.

The present invention may also provide a connector assembly comprising a connector that includes a coupling member rotatably coupled to a body, and the coupling member has an interface end configured to engage a mating connector. A gripping sleeve has a rear end that receives at least a portion of the body and has a front end that receives at least a portion of the coupling member. A torque limiting feature includes a slip element that is located on an inner surface of the gripping sleeve and an engaging element that is located on an outer surface of the coupling member. The slip element and the engaging element engage one another such that rotation of the gripping sleeve applies torque to and rotates the coupling member in a tightening direction until a predetermined torque limit is reached when the slip element disengages from the engaging element allowing the gripping sleeve to rotate with respect to the coupling member such that no additional torque is applied to the coupling member by the gripping sleeve beyond the predetermined torque limit.

The present invention may yet further provide a connector assembly comprising a connector that includes a coupling member rotatably coupled to a body, and the coupling member has an interface end configured to engage a mating connector. A gripping sleeve that has a rear end that receives at least a portion of the body and a front end that receives at least a portion of the coupling member. The gripping sleeve is configured to apply torque to the coupling member. The connector assembly also including a means for limiting torque applied to the coupling member by the gripping sleeve such that the gripping sleeve applies torque to and rotates the coupling member in a tightening direction until a predetermined torque limit is reached allowing the gripping sleeve to rotate with respect to the coupling member such that no additional torque is applied to the coupling member by the gripping sleeve beyond the predetermined torque limit.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing figures.

DETAILED DESCRIPTION OF THE INVENTION

Figure 1:
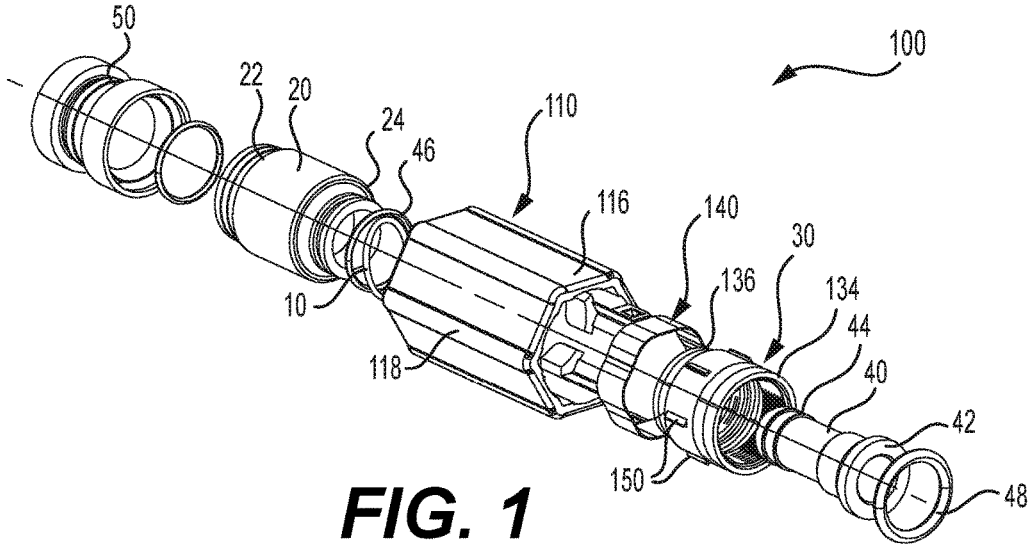
FIG. 1 is an exploded perspective view of a connector assembly according to a first exemplary embodiment of the present invention.

Referring to FIGS. 1, 2, 3A-3C, 4A-4C, 5A-5B, 6, 7, 8A-8C, 9A-9C, 10-12, and 13A-13C, the present invention relates to exemplary embodiments of a connector assembly 100, 200, and 300, that includes a connector, such as a coaxial connector, and a sleeve coupled to the connector which is designed to facilitate gripping and application of torque to the connector while also limiting the amount of torque applied to the connector to prevent overtightening thereof.

The connector of each embodiment of the connector assembly 100, 200, and 300 includes a connector body 20, a coupling member 30, and a post member 40. A compression member 50 may be provided to facilitate termination of the cable with the connector assembly. A grounding member 10 may be provided that is disposed on the outside of the connector body 20 to maintain electrical contact between the coupling member 30 and the connector body 20, thereby even if the connection between the connector 100, 200, or 300 and its mating connector or port becomes loose, as described in commonly assigned U.S. Pat. No. 8,231,412 entitled Electrical Connector With Grounding Member, herein incorporated by reference.

The post member 40 has a substantially tubular shape with an enlarged shoulder end 42 that couples with the coupling member 30, and an opposite end 44 designed to interface with a prepared end of a coaxial cable (not shown), as is well known in the art. The post member 40 is received in both the connector body 20 and the coupling member 30, such that the coupling member 30 rotates with respect to the post member 40 and the connector body 20. The connector body 20 is generally tubular in shape with a first end 22 adapted to couple with the prepared end of the cable, as is well known in the art, and an opposite second end 24 that engages the post member 40. An O-ring 46 may be provided between the coupling member 30 and the second end 24 of the connector body 20 and on compression member 50 to prevent moisture migration.

Figure 2:
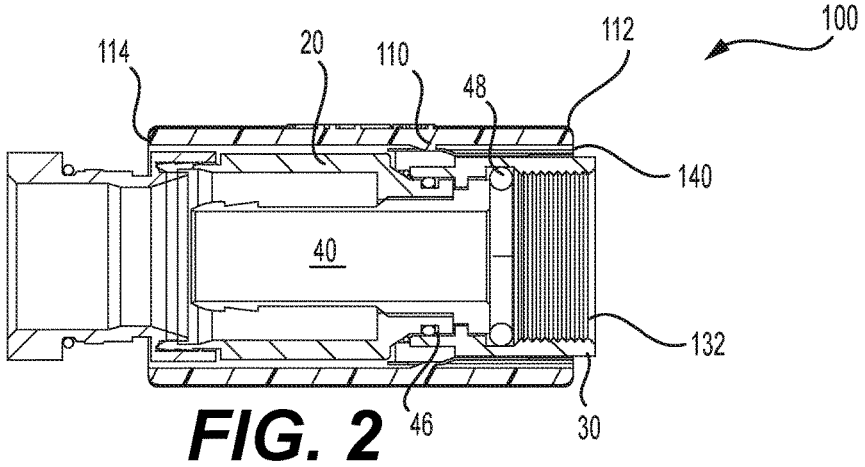
FIG. 2 is cross-sectional view of the connector assembly illustrated in FIG. 1.
Figure 3A:
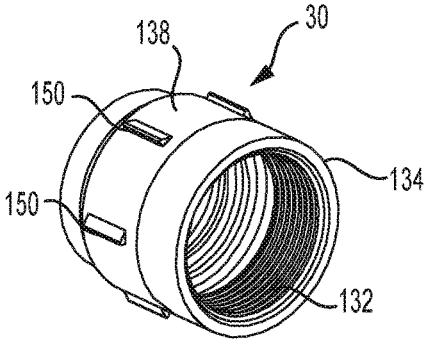
FIGS. 3A-C are various views of a coupling member of the connector assembly illustrated in FIG. 1.

FIGS. 1, 2, 3A-3C, 4A-4C, 5A, and 5B illustrate a first exemplary embodiment of a connector assembly 100 of the present invention. The coupling member 30 of connector assembly 100 is preferably substantially circular or hexagonal in cross-section and may include internal threads 132, as best seen in FIG. 3A, for engaging corresponding external threads of a mating connector or port. The coupling member 30 includes an interface end 134 which engages the mating connector and an opposite free end 136 that catches the enlarged shoulder end 42 of the post member 40, thereby rotatably coupling the coupling member 30 to the post member 40. An O-ring 48 is preferably provided inside of the coupling member 30 to prevent moisture migration.

A gripping sleeve 110 surrounds the connector such that at least a portion of the coupling member 30 is received in a front end 112 of sleeve 110 and at least a portion of the body 20 is received in a rear end 114, as seen in FIG. 2. Sleeve 110 includes an outer surface 116 that may be configured to facilitate gripping of sleeve 110. In a preferred embodiment, outer surface 116 has a substantially hexagonal shape and includes one or more longitudinal extensions 118. The inner surface 120 may include an inwardly extending retaining flange 122 configured to retain sleeve 110 on the connector, as described in commonly assigned U.S. Pat. No. 7,544,094 entitled Connector Assembly With Gripping Sleeve, the subject matter of which is herein incorporated by reference.

Connector assembly 100 incorporates a torque limiting feature that includes a slip element 140 which cooperates with one or more engaging elements 150. Slip element 140 is preferably disposed on inner surface 120 of sleeve 110 near its front end 112. The one or more engaging elements 150 are preferably disposed on an outer surface 138 of coupling member 30. The slip element 140 and the one or more engaging elements 150 engage one another such that rotation of sleeve 110 applies torque to and rotates coupling member 30 in a tightening direction, that is in a direction to tighten coupling member 30 on a mating connector or port, until a predetermined torque limit is reached when the slip element 140 will flex and disengage from the one or more engaging elements 150 allowing sleeve 110 to rotate with respect to the coupling member 30 such that no additional torque is applied to the coupling member 30 by the sleeve 110. Gripping sleeve 110 may also apply torque to coupling member 30 when rotated in the loosening direction to facilitate loosening of coupling member 30.

Figure 5A:
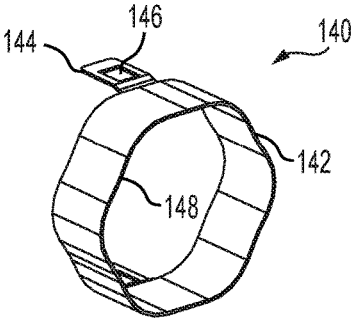
FIGS. 5A and 5B are perspective and end views of a slip element of the connector assembly illustrated in FIG. 1.
Figure 5B:
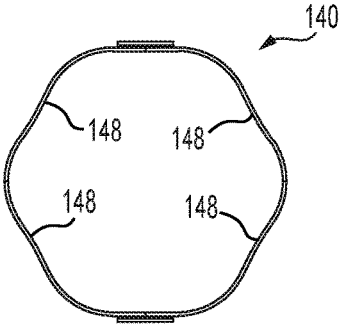
Figure 6:
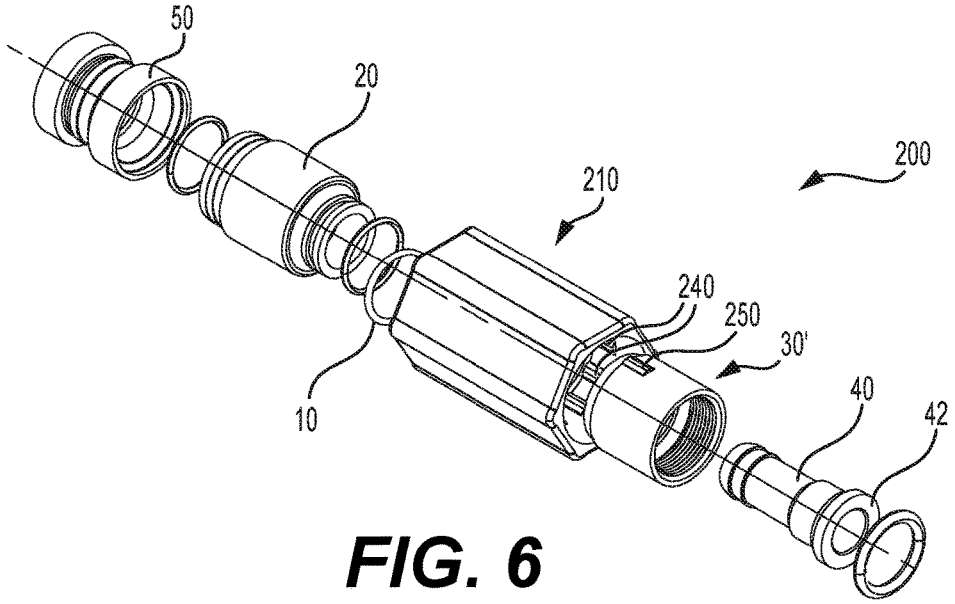
FIG. 6 is an exploded perspective view of a connector assembly according to a second exemplary embodiment of the present invention.
Figure 7:
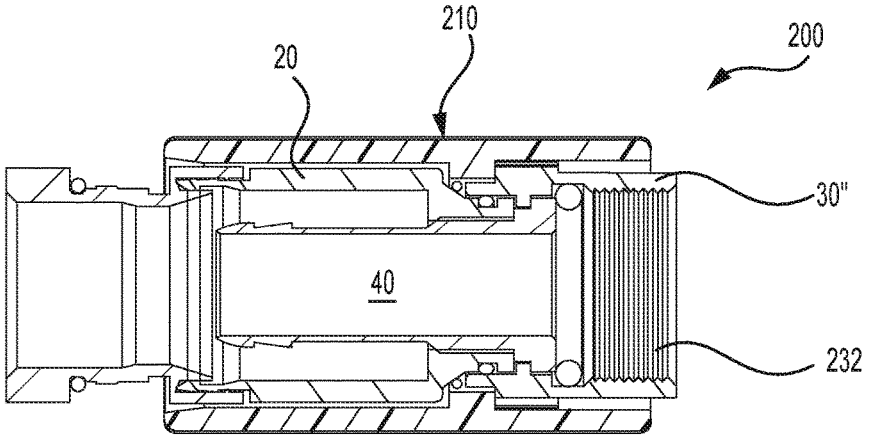
FIG. 7 is a cross-sectional view of the connector assembly illustrated in FIG. 6.

As best seen in FIGS. 1, 5A, and 5B, slip element 140 is preferably a spring that generally has a ring 142. The slip element 140 may be formed of stamped metal. The slip element 140 is preferably separate from sleeve 110 but rests on the sleeve's inner surface 120 positioned against one or more spaced abutments 124 extending from inner surface 120. One or more retaining features 144 may be provided on slip element 140 that correspond to one or more retaining features 126 located on inner surface 120 of sleeve 110, where the retaining features 126 and 144 engage one another for retaining slip element 140 inside sleeve 110. The one more retaining features 126 may be, for example, a detent (FIG. 4C) on the sleeve's inner surface 120 and the one or more retaining features 144 may be, for example, a tab having an opening 146 (FIG. 5A) which receives the detent of sleeve 110.

Slip element or spring 140 may have a substantially wave shape where concave portions thereof define contact points 148 (FIGS. 5A and 5B) for engaging the engaging elements 150 of coupling member 30. In a preferred embodiment, slip element 140 includes four contact points 148; however any number of contact points 148 may be provided including a single contact point 148.

Figure 3B:
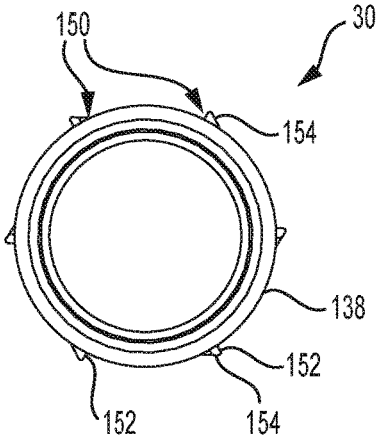
Figure 3C:
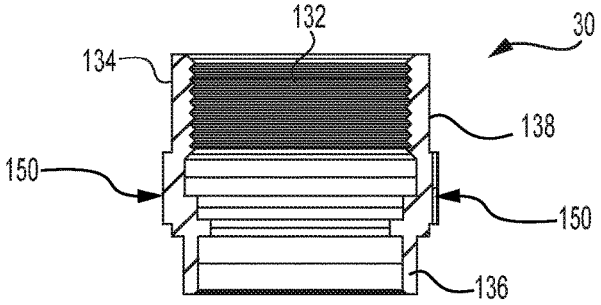
Figure 4A:
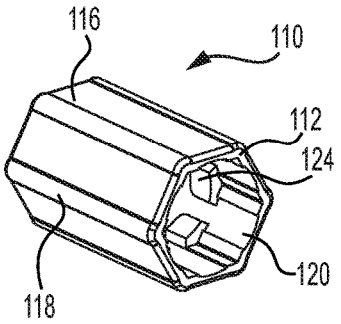
FIGS. 4A-C are various views of a gripping sleeve of the connector assembly illustrated in FIG. 1.
Figure 4B:
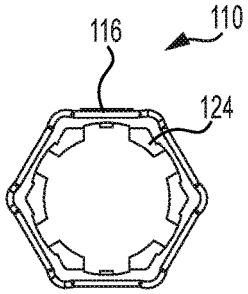
Figure 4C:
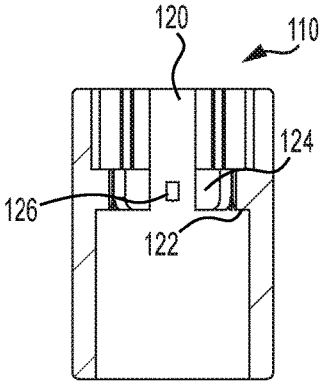

The one more engaging elements 150 may be one or more protrusions which extend from the coupling member's outer surface 138. Each engaging element or protrusion may be positioned longitudinally on outer surface 138 of coupling member 30. Each engaging element or protrusion 150 may include a normal surface 152 and a sloped surface 154 extending away from normal surface 152, as best seen in FIG. 3B. Sloped surface 154 faces away from the tightening direction. The engagement elements or protrusions 150 are preferably annularly and uniformly spaced around the coupling member's outer surface 138.

Each engaging element 150 is designed to engage the one or more contact points 148 such that when sleeve 110 is rotated in the tightening direction, the coupling member 30 also rotates in the tightening direction until the selected and predetermined torque limit is reached. That is, once coupling member 30 is sufficiently tightened on a mating connector or port, slip element 140 of sleeve 110 will slip over the engaging elements 150 of coupling member 30 such that sleeve 110 no longer applies any torque to coupling member. More specifically, the flexible and spring nature of slip element 140 allows the concave contact points 148 thereof to slip over the sloped surfaces 154 of the engaging elements or protrusions 150 when the torque limit is reached so that sleeve 110 can rotate with respect to the coupling member 30. This slipping action can create a clicking sound thereby alerting the user that the torque limit has been reached and the coupling member 30 is sufficiently tight. The value of the predetermined torque limit may be selected, changed or adjusted by changing the depth of the concave contact points 148 into sleeve 110 and/or by changing the thickness of the ring of slip element 140. For example, the deeper the concave contact points 148 is and the thicker the slip element 140 is provides greater resistance when engaging the engaging elements 150 and thus a higher predetermined torque limit value.

FIGS. 6, 7, 8A-8C, and 9A-9C illustrate a second exemplary embodiment of a connector assembly 200 according to the present invention. Connector assembly 200 of the second embodiment is similar to the first embodiment, except that the slip element 240 of the second embodiment is not separate from the sleeve 210 and preferably includes one or more ribs 242 extending from the sleeve's inner surface 220. Ribs 242 may be annularly spaced around the inner surface 220 of sleeve 210 and located adjacent to the inner retaining flange 122. Each rib 242 preferably extends longitudinally inside sleeve 210.

Figure 8A:
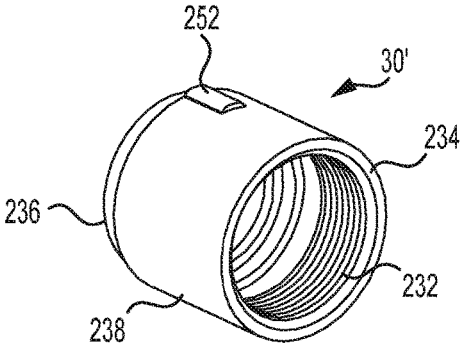
FIGS. 8A-8C are various view of a coupling member of the connector assembly illustrated in FIG. 6.
Figure 8B:
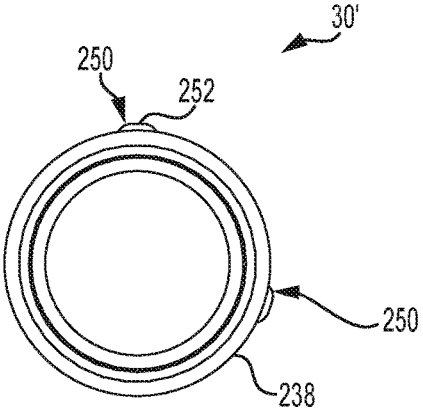
Figure 8C:
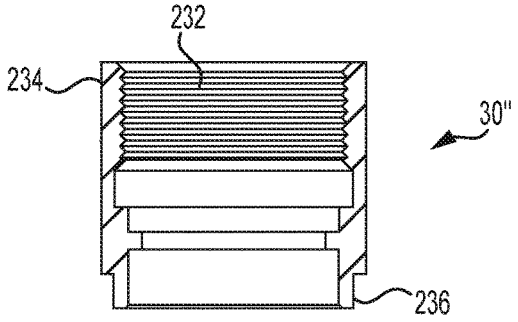
Figure 9A:
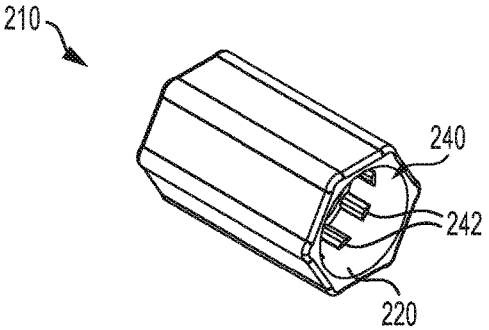
FIGS. 9A-9C are various views of a gripping sleeve of the connector assembly illustrated in FIG. 6.
Figure 9B:
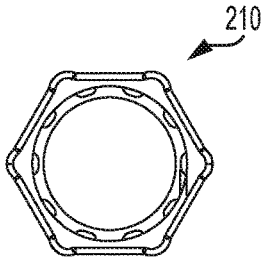
Figure 9C:
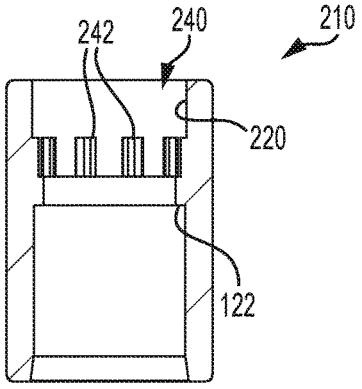
Figure 10:
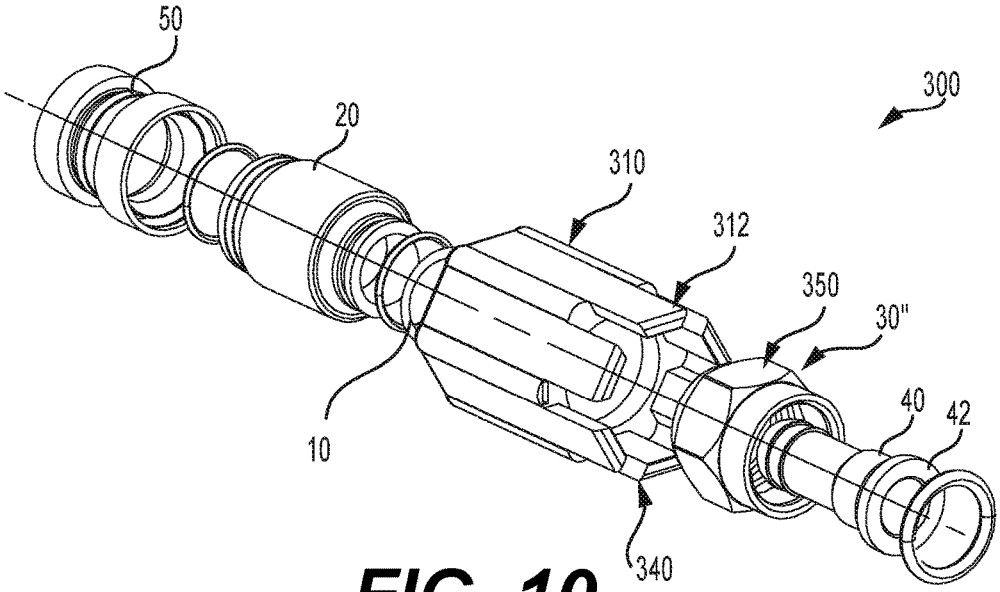
FIG. 10 is an exploded perspective view of a connector assembly according to a third exemplary embodiment of the present invention.

The coupling member 30' of connector assembly 200 is similar to the coupling member 30 of the first embodiment, except that the engaging elements or protrusions 250 of coupling member 30' preferably have a different more rounded shape than the engaging elements or protrusions 150 of the first embodiment and includes a rounded face 252. The coupling member 30' is substantially circular in cross-section, as seen in FIG. 8B, and may include internal threads 232, as best seen in FIG. 8A, for engaging corresponding external threads of a mating connector or port. The coupling member 30' includes an interface end 234 which engages the mating connector and an opposite free end 236 that catches the enlarged shoulder end 42 of the post member 40, thereby rotatably coupling the coupling member 30 to the post member 40. In a preferred embodiment, two spaced engaging elements 250 are provided on the outer surface 238 of coupling member 30' and are located closer to the free end 236 of coupling member 30' than the interface end 234. However, any number of engaging elements 250 may be provided including a single engaging element. In a preferred embodiment, the engaging elements 250 are spaced further apart from one another than the spacing between the ribs 242.

Each engaging element 250 is designed to engage the one or more of the ribs 242 when sleeve 210 is rotated in the tightening direction, the coupling member 30' also rotates in the tightening direction until the selected and predetermined torque limit is reached. Once coupling member 30' is sufficiently tightened on a mating connector or port, the one or more ribs 242 of slip element 240 of sleeve 210 will slip over the rounded faces 252 of the engaging elements 250 of coupling member 30' such that sleeve 210 no longer applies any more torque than the predetermined torque to coupling member. Similar to the first embodiment, this slipping action can create a clicking sound thereby alerting the user that the torque limit has been reached and the coupling member 30' is sufficiently tight. The value of the predetermined torque limit may be selected, changed or adjusted by changing the height/depth and/or of the ribs 242 on sleeve 210 and/or changing the height and/or shape of the engaging elements 250 on coupling member 30'. For example, the greater the height or depth of the ribs 242 and/or the engaging elements 250, the greater the resistance is when the slip element 240 engages the engaging elements 250, thereby resulting in a higher predetermined torque limit value. Gripping sleeve 210 may also apply torque to coupling member 30' when rotated in the loosening direction to facilitate loosening of coupling member 30'.

FIGS. 10-12 and 13A-13C illustrate a third exemplary embodiment of the connector assembly 300 in accordance with the present invention. Connector assembly 300 is similar to the first and second embodiments in that it includes a sleeve 310 that slips over the coupling member 30" when a predetermined torque limit is reached. Sleeve 310 includes slip element 340 which comprises one or more flexible fingers 342 extending from the front end 312 of sleeve 310. The one or more flexible fingers 342 are preferably spaced from one another by a slot 344. Each finger 342 may include a substantially flat inner surface portion 346 for engaging coupling member 30".

Figure 11:
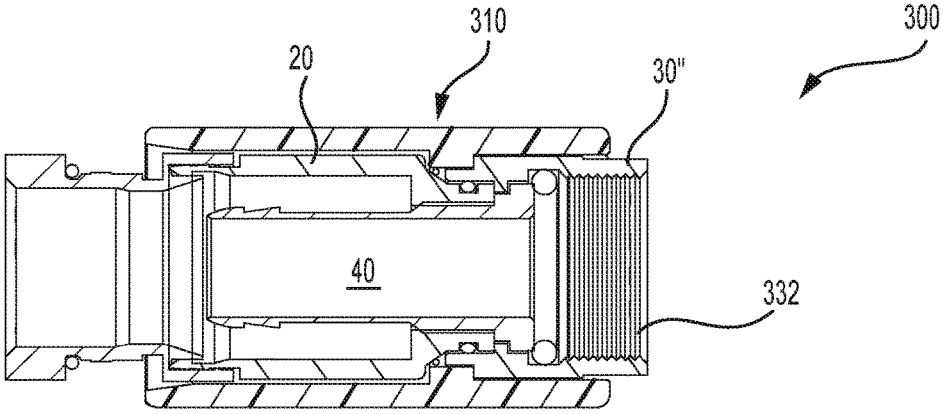
FIG. 11 is a cross-sectional view of the connector assembly illustrated in FIG. 10.
Figure 12:
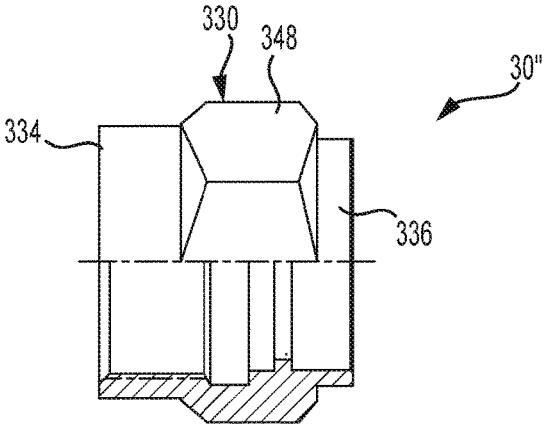
FIG. 12 is an elevational view of a coupling member of the connector assembly illustrated in FIG. 10.
Figure 13A:
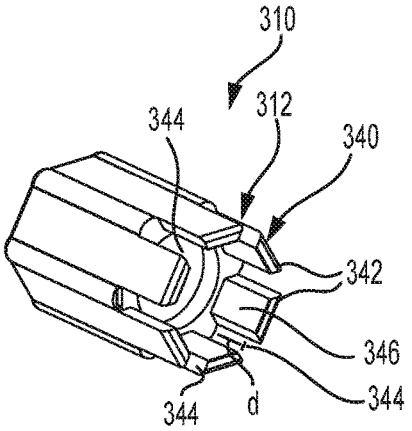
FIGS. 13A-13C are various views of a gripping sleeve of the connector assembly illustrated in FIG. 10.
Figure 13B:
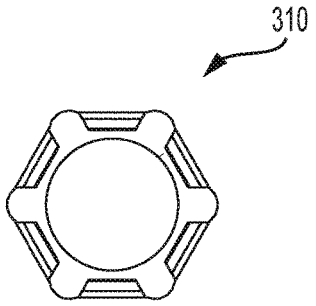
Figure 13C:
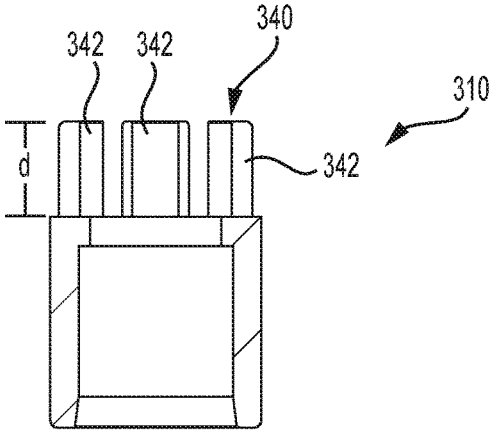

Coupling member 30" preferably has a substantially hexagonally shaped portion 330, as seen in FIG. 12, and may include internal threads 332, as best seen in FIG. 11, for engaging corresponding external threads of a mating connector or port. The coupling member 30" includes an interface end 334 which engages the mating connector and an opposite free end 336 that catches the enlarged shoulder end 42 of the post member 40, thereby rotatably coupling the coupling member 30 to the post member 40. The hexagonally shaped portion 330 includes engaging elements 350 adapted to frictionally engage the one or more flexible fingers 342 of sleeve 310. Each engaging element 350 preferably comprises a substantially flat portion 348 on the outer surface of the hexagonally shaped portion of coupling member 30".

Each substantially flat portion 348 of coupling member 30" is designed to engage a corresponding substantially flat inner surface portion 346 of the one more flexible fingers 342 of sleeve 310 such that when sleeve 310 is rotated in the tightening direction, the coupling member 30" also rotates in the tightening direction until the selected and predetermined torque limit is reached. Once coupling member 30" is sufficiently tightened on a mating connector or port, the one or more flexible fingers 342 of slip element 340 of sleeve 310 will slip over the substantially flat portions 348 of coupling member 30" such that sleeve 310 no longer applies any torque to coupling member. Gripping sleeve 310 may also apply torque to coupling member 30" when rotated in the loosening direction to facilitate loosening of coupling member 30".

The value of the predetermined torque limit for connector assembly 300 may be selected, changed or adjusted by changing the depth d of the slots 344 between the one or more fingers 342. The depth d of the slots 344 may be measure from an end face 349 at the front end 312 of sleeve 310. For example, the greater the depth d of slots 344, the more flexible the fingers 342 are, thereby allowing the fingers 342 to more easily slip over the hexagonally shaped portion 330 of coupling member 30", resulting in a lower value for the predetermined torque limit.

While particular embodiments have been chosen to illustrate the invention, it will be understood by those skilled in the art that various changes and modifications can be made therein without departing from the scope of the invention as defined in the appended claims.

What is claimed is:

1. A connector assembly, comprising:

a connector including a coupling member rotatably coupled to a body, said coupling member having an interface end configured to engage a mating connector;

a gripping sleeve having a rear end that receives at least a portion of said body and a front end that receives at least a portion of said coupling member; and a torque limiting feature including a slip element located at or near said front end of said gripping sleeve and an engaging element located on said coupling member, wherein said slip element and said engaging element engage one another such that rotation of said gripping sleeve applies torque to and rotates said coupling member in a tightening direction until a predetermined torque limit is reached when said slip element disengages from said engaging element allowing said gripping sleeve to rotate with respect to said coupling member such that no additional torque applied to said coupling member by said gripping sleeve beyond said predetermined torque limit.

2. A connector assembly according to claim 1, wherein said slip element is a spring.

3. A connector assembly according to claim 2, wherein said spring has a substantially wave shape with at least one concave contact point for engaging said engaging element.

4. A connector assembly according to claim 3, wherein a value of said predetermined torque limit is based on a depth of said at least one concave contact point.

5. A connector assembly according to claim 2, wherein said spring forms a ring.

6. A connector assembly according to claim 5, wherein a value of said predetermined torque limit is based on a thickness of said ring.

7. A connector assembly according to claim 2, wherein said spring is separate from said gripping sleeve.

8. A connector assembly according to claim 2, wherein said spring includes a retaining feature corresponding to a retaining feature located on an inner surface of said gripping sleeve, said retaining features engage one another for retaining said spring inside said gripping sleeve.

9. A connector assembly according to claim 2, wherein said spring is formed of stamped metal or plastic.

10. A connector assembly according to claim 2, wherein an inner surface of said gripping sleeve includes at least one abutment for abutting an end of said spring.

11. A connector assembly according to claim 1, wherein said engaging element is at least one protrusion on an outer surface of said coupling member, said at least protrusion extending in a longitudinal direction.

12. A connector assembly according to claim 11, wherein said at least protrusion includes a normal surface and a sloped surface extending from said normal surface, said sloped surface facing away from said tightening direction.

13. A connector assembly according to claim 11, wherein said at least protrusion includes a rounded face that engages said slip element.

14. A connector assembly according to claim 1, wherein said slip element is at least one rib located on an inner surface of said gripping sleeve.

15. A connector assembly according to claim 14, wherein a value of said predetermined torque limit is based on a height and shape of said at least one rib.

16. A connector assembly according to claim 14, wherein said at least one rib is spaced from an end face of said gripping sleeve and adjacent an inner retaining flange of said gripping sleeve.

17. A connector assembly according to claim 1, wherein said slip element includes a plurality of ribs annularly spaced on an inner surface of said gripping sleeve.

18. A connector assembly according to claim 1, wherein said engaging element includes a plurality of protrusions spaced on an outer surface of said coupling nut, each of said plurality of protrusions extending in a longitudinal direction.

19. A connector assembly according to claim 1, wherein said slip element includes a plurality of flexible fingers spaced from one another by slot, each slot having a depth from an end face of said gripping sleeve.

20. A connector assembly according to claim 19, wherein a value of said predetermined torque limit is based on said depth of said slots.

21. A connector assembly according to claim 19, wherein each of said plurality of flexible fingers has a substantially flat inner surface portion for engaging said engaging element.

22. A connector assembly according to claim 1, wherein said engaging element is at least one substantially flat portion of an outer surface of said coupling member for frictionally engaging said slip element of said gripping sleeve.

23. A connector assembly, comprising:

a connector including a coupling member rotatably coupled to a body, said coupling member having an interface end configured to engage a mating connector;

a gripping sleeve having a rear end that receives at least a portion of said body and a front end that receives at least a portion of said coupling member; and a torque limiting feature including a slip element located on an inner surface of said gripping sleeve and an engaging element located on an outer surface of said coupling member, wherein said slip element and said engaging element engage one another such that rotation of said gripping sleeve applies torque to and rotates said coupling member in a tightening direction until a predetermined torque limit is reached when said slip element disengages from said engaging element allowing said gripping sleeve to rotate with respect to said coupling member such that no additional torque is applied to said coupling member by said gripping sleeve beyond said predetermined torque limit.

24. A connector assembly according to claim 23, wherein said slip element is a spring having a substantially wave shape with a plurality of concave contact points; and said engaging element is a plurality of protrusions, said plurality of protrusions are annularly spaced on said outer surface of said coupling member.

25. A connector assembly according to claim 24, wherein a value of said predetermined torque limit is based on a depth of said plurality of concave contact points.

26. A connector assembly according to claim 24, wherein each of said plurality of protrusions extends in a longitudinal direction and each of said plurality of protrusions includes a normal surface and a sloping surface extending from said normal surface, each of said sloping surfaces face away from the tightening direction.

27. A connector assembly according to claim 23, wherein said slip element is a plurality of annularly spaced ribs and said engaging element is a plurality of annularly spaced protrusions.

28. A connector assembly according to claim 27, wherein said plurality of annularly spaced protrusions are spaced further apart from one another than the spacing between said plurality of ribs.

29. A connector assembly according to claim 27, wherein a value of said predetermined torque limit is based on a height and shape of each of said plurality of ribs or a height and shape of each of said plurality of protrusions.

30. A connector assembly according to claim 23, wherein said slip element is plurality of flexible fingers spaced from each other by slots, said engaging element is substantially flat portions of said outer surface of said coupling member, each of said plurality of flexible fingers has a substantially flat inner surface portion for frictionally engaging said substantially flat portions of said outer surface of said coupling member.

31. A connector assembly according to claim 30, wherein a value of said predetermined torque limit is based on a depth of said slots between said flexible fingers.

32. A connector assembly, comprising:

a connector including a coupling member rotatably coupled to a body, said coupling member having an interface end configured to engage a mating connector;

a gripping sleeve having a rear end that receives at least a portion of said body and a front end that receives at least a portion of said coupling member, said gripping sleeve being configured to apply torque to said coupling member; and means for limiting torque applied to said coupling member by said gripping sleeve such that said gripping sleeve applies torque to and rotates said coupling member in a tightening direction until a predetermined torque limit is reached allowing said gripping sleeve to rotate with respect to said coupling member such that no additional torque is applied to said coupling member by said gripping sleeve beyond said predetermined torque limit.

33. A connector assembly according to claim 32, wherein said means for limiting torque includes slip element comprising a spring disposed on an inner surface of said gripping sleeve and having a substantially wave shape with a plurality of concave contact points, and an engaging element comprising a plurality of protrusions, said plurality of protrusions are annularly spaced on an outer surface of said coupling member.

34. A connector assembly according to claim 32, wherein a value of said predetermined torque limit is based on a depth of said plurality of concave contact points.

35. A connector assembly according to claim 32, wherein said means for limiting torque includes slip element comprising a plurality of annularly spaced ribs on an inner surface of said gripping sleeve and an engaging element comprising a plurality of annularly spaced protrusions on an outer surface of said coupling member.

36. A connector assembly according to claim 35, wherein said plurality of annularly spaced protrusions are spaced further apart from one another than the spacing between said plurality of ribs.

37. A connector assembly according to claim 35, wherein a value of said predetermined torque limit is based on a height and shape of each of said plurality of ribs or a height of each of said plurality of protrusions.

38. A connector assembly according to claim 32, wherein said means for limiting torque includes a slip element comprising plurality of flexible fingers located at a front end of said gripping sleeve and spaced from each other by slots, and an engaging element comprising substantially flat portions of an outer surface of said coupling member, each of said plurality of flexible fingers has a substantially flat inner surface portion for frictionally engaging said substantially flat portions of said outer surface of said coupling member.

39. A connector assembly according to claim 38, wherein a value of said predetermined torque limit is based on a depth of said slots between said flexible fingers.

* * * * *